US007327323B2

(12) United States Patent
Jackson et al.

(10) Patent No.: US 7,327,323 B2
(45) Date of Patent: Feb. 5, 2008

(54) COMMUNICATION APPARATUS, METHOD OF TRANSMISSION AND ANTENNA APPARATUS

(75) Inventors: Timothy Jackson, Cambridge (GB); Esen Bayar, London (GB)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/450,191

(22) PCT Filed: Dec. 19, 2001

(86) PCT No.: PCT/GB01/05654

§ 371 (c)(1),
(2), (4) Date: Oct. 21, 2003

(87) PCT Pub. No.: WO02/50947

PCT Pub. Date: Jun. 27, 2002

(65) Prior Publication Data

US 2004/0077320 A1 Apr. 22, 2004

(30) Foreign Application Priority Data

Dec. 19, 2000 (GB) ..... 0030932

(51) Int. Cl.
*H01Q 3/00* (2006.01)

(52) U.S. Cl. ..... 343/757; 342/359

(58) Field of Classification Search ..... 343/757, 343/753, 754, 761, 762, 758
See application file for complete search history.

(56) References Cited

U.S. PATENT DOCUMENTS

| | | | | | |
|---|---|---|---|---|---|
| 3,611,395 | A | * | 10/1971 | Carberry, Jr. | 343/762 |
| 4,070,678 | A | * | 1/1978 | Smedes | 343/754 |
| 4,786,912 | A | * | 11/1988 | Brown et al. | 343/761 |
| 5,486,835 | A | | 1/1996 | Hock | 342/359 |
| 5,552,797 | A | | 9/1996 | Cook | 343/786 |
| 5,614,916 | A | | 3/1997 | Mizuguchi | 343/786 |
| 5,757,330 | A | * | 5/1998 | Parfitt | 343/772 |
| 6,014,108 | A | | 1/2000 | Lynch et al. | 343/753 |
| 6,072,437 | A | * | 6/2000 | Zimmerman et al. | 343/753 |
| 6,426,814 | B1 | | 7/2002 | Berger et al. | 398/45 |

FOREIGN PATENT DOCUMENTS

| | | |
|---|---|---|
| EP | 0 452 970 A3 | 10/1991 |
| GB | 2 321 368 A | 7/1998 |
| WO | WO 01/28162 | 4/2001 |

* cited by examiner

*Primary Examiner*—Don Wong
*Assistant Examiner*—Huedung X. Cao
(74) *Attorney, Agent, or Firm*—Blakely, Sokoloff, Taylor & Zafman LLP

(57) ABSTRACT

Communications apparatus has a plurality of nodes each of which is capable of communicating with plural other nodes via point-to-point wireless transmission links between the nodes. At least one of the nodes has at least one antenna that is steerable in azimuth. The antenna is arranged to transmit an electromagnetic beam that has a beam width that is narrower in azimuth than in elevation. The beam width in azimuth is less than 9° and the beam width in elevation is less than about 15°.

21 Claims, 4 Drawing Sheets

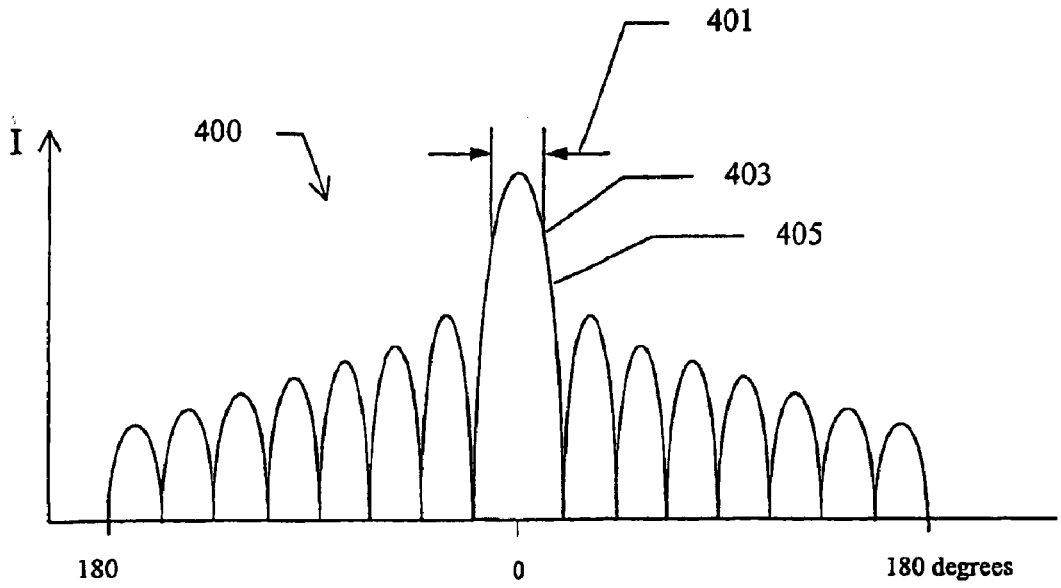
Figure 2A: Elevation Beamwidth
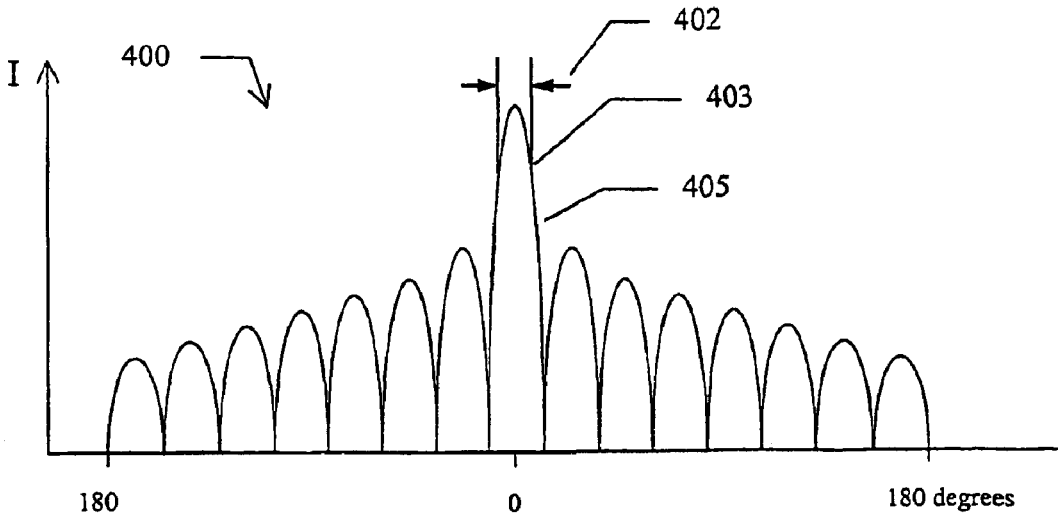
Figure 2B: Azimuth Beamwidth

COMMUNICATION APPARATUS, METHOD OF TRANSMISSION AND ANTENNA APPARATUS

This application is the National Phase of International Application PCT/GB01/05654 filed Dec. 19, 2001 which designated the U.S. and that International Application was published in English under PCT Article 21 (2) on Jun. 27, 2002 as International Publication Number WO 02/50947 A1. PCT/GB01/05654 claims priority to British Application No. 0030932.8, filed Dec. 19, 2000. The entire contents of these applications are incorporated herein by reference.

The present invention relates to communications apparatus, to a method of transmission, and to antenna apparatus.

Wireless communications offers many attractive features in comparison with wired communications. For example, a wireless system is very much cheaper to install as no mechanical digging or laying of cables or wires is required and user sites can be installed and de-installed very quickly.

It is a feature of wireless systems when a large bandwidth (data transfer rate) is required that, as the bandwidth which can be given to each user increases, it is necessary for the bandwidth of the wireless signals to be similarly increased. Furthermore, the frequencies which can be used for wireless transmission are closely regulated. It is a fact that only at microwave frequencies (i.e. in the gigahertz (GHz) region) or higher are such large bandwidths now available as the lower radio frequencies have already been allocated.

A problem with microwave or higher frequencies is that these radio frequencies are increasingly attenuated or completely blocked by obstructions such as buildings, vehicles, trees, etc. Such obstructions do not significantly attenuate signals in the megahertz (MHz) band but becomes a serious problem in the gigahertz (GHz) band. Thus, conventional wisdom has been that microwave or higher frequencies are difficult to use in a public access network which provides communication with a large number of distributed users.

The spectral efficiency of any wireless communications system is extremely important as there are many demands on radio bandwidth. As a matter of practice, the regulatory and licensing authorities are only able to license relatively narrow regions of the radio spectrum.

A cellular system, which uses point-to-multipoint broadcasts, places high demands on the radio spectrum in order to provide users with a satisfactory bandwidth and is therefore not very efficient spectrally.

The use of repeaters or relays in such systems to pass on data from one station to another is well known in many applications. In general, such repeaters broadcast signals, in a point-to-multipoint manner, and are therefore similar to a cellular approach and suffer from a corresponding lack of spectral efficiency.

A "mesh" communications system, which uses a multiplicity of point-to-point wireless transmissions, can make more efficient use of the radio spectrum than a cellular system. An example of a mesh communications system is disclosed in our International patent application WO-A-98/27694, the entire disclosure of which is incorporated herein by reference. In a typical implementation of a mesh communications system, a plurality of nodes are interconnected using a plurality of point-to-point wireless links. Each node is typically stationary or fixed and the node is likely to contain equipment that is used to connect a subscriber or user to the system. Each node has apparatus for transmitting and for receiving wireless signals over the plurality of point-to-point wireless links and is arranged to relay data if data received by said node includes data for another node. At least some, more preferably most, and in some cases all, nodes in the fully established mesh of interconnected nodes will each be associated with a subscriber, which may be a natural person or an organisation such as a company, university, etc. Each subscriber node will typically act as the end point of a link dedicated to that subscriber (i.e. as a source and as a sink of data traffic) and also as an integral part of the distribution network for carrying data intended for other nodes. The non-subscriber nodes may be provided and operated by the system operator in order to provide for better geographical coverage to subscribers to the system. The frequency used may be for example at least about 1 GHz. A frequency greater than 2.4 GHz or 4 GHz may be used. Indeed, a frequency of 28 GHz, 40 GHz, 60 GHz or even 200 GHz may be used. Beyond radio frequencies, other yet higher frequencies such as of the order of 100,000 GHz (infra-red) could be used.

Within a mesh communications system, each node is connected to one or more neighbouring nodes by separate point-to-point wireless transmission links. When combined with the relay function in each node, it becomes possible to route information through the mesh by various routes. Information is transmitted around the system in a series of "hops" from node to node from the source to the destination. By suitable choice of node interconnections it is possible to configure the mesh to provide multiple alternative routes, thus providing improved availability of service.

A mesh communications system can make more efficient use of the spectrum by directing the point-to-point wireless transmissions along the direct line-of-sight between the nodes, for example by using highly directional beams. This use of spatially directed transmissions reduces the level of unwanted transmissions in other spatial regions and also provides significant directional gain such that the use of spatially directed transmissions as a link between nodes allows the link to operate over a longer range than is possible with a less directional beam. By contrast, a cellular system is obliged to transmit over a wide spatial region in order to support the point-to-multipoint transmissions. This is typically achieved in a cellular system by having a base station of the cellular system transmit a beam which has a very wide beam width in azimuth (typically being a sector of 60 degrees, 120 degrees or omnidirectional) but which has a narrower beam width in elevation, i.e. the beam from a base station in a cellular system is typically relatively horizontally flat and wide.

In addition to the improved spectral efficiency, a mesh communications system can benefit from improved performance by using high gain antennas to direct the point-to-point wireless transmissions, thereby improving the quality of such transmissions. Furthermore, the mesh topology can provide improved coverage because the direction of the various wireless links can be adjusted to direct the wireless transmissions around obstructions.

It is possible to consider a mesh network that is assembled by static configuration of point-to-point links, where the direction of the links is determined at the time of installation. However, an improved mesh network is possible if the nodes are capable of changing the direction of one or more of the point-to-point links. This ability to redirect and reconfigure the links can be used to support the growth and evolution of the mesh network, since it means that the nodes are capable of rearranging the point-to-point links between nodes.

In a typical mesh communications system, each node is required to support multiple point-to-point wireless links, each of the wireless links connecting the node to a respective other node. In order to support these multiple wireless links and be capable of changing the direction of one or more of the wireless links, it is preferred for the node to be able to steer the antennas that provide for the transmission and reception of the wireless transmissions along the links.

Many radar systems are known, particularly for aircraft landing control purposes, in which a generally fan-shaped radio beam is used in which the fan shape is arranged in a vertical plane, often in conjunction with a fan-shaped beam arranged in a horizontal plane. The purpose of the fan shape is to maximise as far as possible the gain. Examples of such systems are disclosed in GB870707, GB826014, U.S. Pat. No. 4,933,681 and U.S. Pat. No. 5,844,527.

In WO-A-94/26001 there is disclosed an arrangement by which steerable antennas are provided for use in a wireless local area network. In the specific example described, three pillbox antennas are arranged one above the other and a fourth, omnidirectional antenna is placed above the three pillbox antennas. Each pillbox antenna is arranged to operate at a frequency of 56 GHz with a beam width in azimuth of 9° and a beam width in elevation of 20°. At this sort of frequency, a beam width in azimuth of 9° can effectively be regarded as sectorial in that the beam width in elevation is relatively wide compared to a typical point-to-point link at that frequency. Thus, each pillbox antenna has a sector type transmission/reception pattern, which in a wireless LAN environment is presumably tolerable and indeed preferred on the basis that spectral efficiency in a wireless LAN is barely an issue due to the large amount of radio spectrum typically available at those frequencies and because of the very short links.

According to a first aspect of the present invention, there is provided communications apparatus, the apparatus comprising: a plurality of nodes, each node being capable of communicating with plural other nodes via point-to-point wireless transmission links between the nodes; at least one of the nodes comprising at least one antenna that is steerable in azimuth, wherein the at least one antenna is arranged to transmit an electromagnetic beam that has a beam width that is narrower in azimuth than in elevation, the beam width in azimuth being less than about 9° and the beam width in elevation being less than about 15°.

It will be understood that the expression "beam width" as used herein has the conventional meaning of the angle subtended at the antenna by the half intensity points of the beam (i.e. the points where the power density of the beam is half that or 3 dB less than the maximum power density of the beam).

By providing a beam that has a beam width that is narrow in azimuth, spectral efficiency can be increased. This is because, in a typical implementation, the same frequency may be used at plural different spatial locations and this reuse of the same frequency can lead to interference of the wanted signals at a node by unwanted signals from other nodes, said unwanted interference including a multiplicity of interfering transmissions, for example interference caused by other wireless transmissions that are using the same frequency, hereafter referred to as "co-channel interference", and interference caused by wireless transmissions using adjacent frequencies, hereafter referred to as "adjacent channel interference". In the preferred implementation, by using directional antennas in a mesh system as described above, the aggregate levels of both co-channel interference and adjacent channel interference can be reduced and this allows more reuse of the frequencies for a given level of interference and/or a reduction in the absolute level of interference and/or a reduction in the amount of spectrum required to service a set of users.

Furthermore, given that in a typical implementation, where the antenna apparatus is associated with a node in a mesh communications system of the type described above and in which the node to which transmissions are being directed may be at a different elevation to the node from which transmissions are being sent, having a beam width that is relatively wide in elevation (i.e. a tall beam) means that the beam is more likely to reach the target node without the transmitting antenna having to be steered in elevation. In other words, whilst in practice it may be desirable or even necessary for the antenna of the transmitting node to be steerable in azimuth to permit the use of a narrow beam width in azimuth, it is desirable to use a wider beam width in elevation since this makes it less likely that the antenna of the transmitting node needs to be steerable in elevation, and the resulting combination of different azimuth and elevation beam widths results in an asymmetric beam. It will be appreciated that if it is desirable or necessary for the antenna of the transmitting node to be steerable in azimuth, then said antenna can be mechanically steerable or electronically steerable or both, possibly with mechanical steering being used for coarse steering and electronic steering being used for fine steering once the antenna is directed in approximately the correct direction. Similar considerations apply for the antenna at the receiving node.

A further advantage of the asymmetric beam is that it can reduce the effect of wind loading on the antenna, which can be important in practice in those implementations in which the antenna apparatus is mounted outdoors. For example, for an antenna mounted on a pole or the like, the effect of wind loading is typically to bend the pole to cause the antenna supports to tilt away from the horizontal plane. This movement of the antenna can lead to significant depointing in the elevation plane, while producing no or less depointing in the azimuth plane. Having a beam width that is greater in elevation means that the antenna apparatus is less sensitive to the depointing effects of wind loading.

A yet further advantage of the asymmetric beam is its effect on the overall height of the antenna apparatus. In particular, to produce a beam that has a beam width that is narrower in azimuth than in elevation, the antenna will typically be relatively short from top to bottom (to produce a relatively large beam width in elevation) and relatively wide from side to side (to produce a relatively narrow beam in azimuth). This means that the overall height of the antenna apparatus can be less for corresponding frequencies and antenna gain than if for example a symmetrical beam were used. It will be understood that planning regulations and also aesthetics may mean that a relatively short antenna apparatus is highly desirable. Moreover, for a given size of antenna, higher directivity (i.e. increased gain and reduced beam width) can be achieved by increasing the frequency. In the typical implementation, where the antenna apparatus is associated with a node in a mesh communications system of the type described above, this effect can be used to compensate for the increased path loss that occurs for wireless transmission links that are operating at higher frequencies. For example, if a node is redesigned to operate at a higher frequency while keeping the overall dimensions of the antenna the same, then the antenna can be designed to provide a higher gain (for said given dimensions) and this can compensate for the increased path loss when operating at said higher frequencies.

Said at least one antenna may be arranged so that the transmitted beam is elliptical in cross-section with the major axis in elevation and the minor axis in azimuth.

Said at least one antenna may be arranged so that the transmitted beam has a beam width in azimuth which is in the range 2° to 5°.

Said at least one antenna may be arranged so that the transmitted beam has a beam width in elevation which is in the range 5° to 10°. In a typical implementation in which the antenna apparatus is used, where the antenna apparatus is associated with a node in a mesh communications system of the type described above, the node to which transmissions are being directed will normally be within a range of a few degrees of elevation from the transmitting node. This preferred range for the elevation beam width should be sufficient to enable most or all such target nodes to be reached without requiring steering in elevation of the transmitting antenna.

The nodes are preferably arranged so that wireless transmissions between the nodes take place at a frequency in the range 1 GHz to 100 GHz. Specific preferred frequencies are in the range about 24 GHz to about 30 GHz or in the range about 40 GHz to about 44 GHz.

According to a second aspect of the present invention, there is provided a method of wireless transmission between a first node and a second node, the first node having an antenna for wireless transmission of a signal, the second node having an antenna for receiving the wireless transmission from the first node, the method comprising the steps of: transmitting an electromagnetic beam having a beam width that is narrower in azimuth than in elevation from the first node to the second node, the beam width in azimuth being less than about 9° and the beam width in elevation being less than about 15°.

The method preferably comprises the step of receiving said electromagnetic beam at the second node with an antenna that has a beam width that is narrower in azimuth than in elevation. It is preferred that the beam be received with an antenna that has a beam width that is narrower in azimuth than in elevation as this in itself (i) helps to keep down the reception of unwanted signals from nodes other than said first node and from other equipment, and (ii) helps to ensure that signals can be received from the first node even if the first and second nodes are not at the same elevation. This arrangement also helps in some arrangements to alleviate the effect of wind loading on the support that carries the antenna at the second node.

The antenna of the first node is preferably steerable in azimuth, the method preferably comprising the step of, prior to transmitting the electromagnetic beam, steering the antenna of the first node in azimuth to direct the electromagnetic beam towards the antenna of the second node.

The antenna of the second node is preferably steerable in azimuth, the method preferably comprising the step of steering the antenna of the second node in azimuth to direct the antenna of the second node towards the antenna of the first node.

The transmitted beam is preferably elliptical in cross-section with the major axis in elevation and the minor axis in azimuth.

The antenna of the first node is preferably arranged so that the transmitted beam has a beam width in azimuth that is in the range 2° to 5°.

The antenna of the first node is preferably arranged so that the transmitted beam has a beam width in elevation that is in the range 5° to 10°.

Wireless transmissions between the nodes preferably take place at a frequency in the range 1 GHz to 100 GHz.

According to a third aspect of the present invention, there is provided antenna apparatus for use in a communications apparatus which comprises a plurality of nodes, each node being capable of communicating with plural other nodes via point-to-point wireless transmission links between the nodes, the antenna apparatus comprising at least one antenna that is steerable in azimuth, wherein the at least one antenna is arranged to transmit an electromagnetic beam that has a beam width that is narrower in azimuth than in elevation, the beam width in azimuth being less than about 9° and the beam width in elevation being less than about 15°.

Said at least one antenna may be arranged so that the transmitted beam is elliptical in cross-section with the major axis in elevation and the minor axis in azimuth.

Said at least one antenna may be arranged so that the transmitted beam has a beam width in azimuth that is in the range 2° to 5°.

Said at least one antenna may be arranged so that the transmitted beam has a beam width in elevation that is in the range 5° to 10°.

The apparatus is preferably arranged so that wireless transmissions take place at a frequency in the range 1 GHz to 100 GHz.

Embodiments of the present invention will now be described by way of example with reference to the accompanying drawings, in which:

FIGS. 2A and 2B show an example of a typical radiation pattern for a beam transmitted by an antenna in accordance with the preferred embodiment of the present invention;

Figure 1:
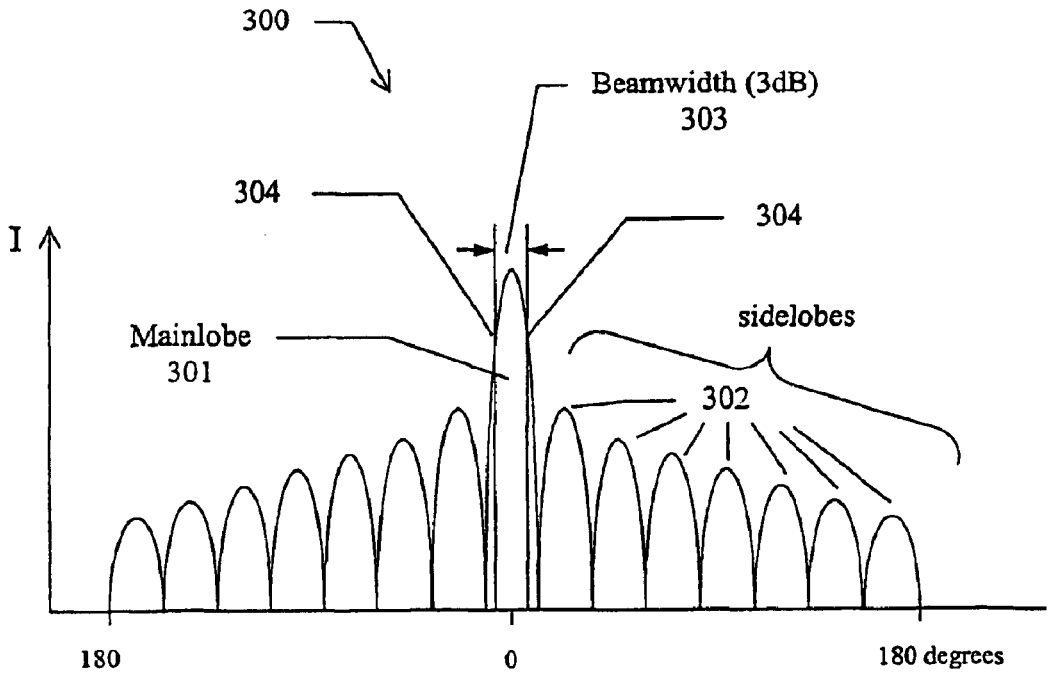
FIG. 1 shows a typical radiation pattern for a symmetrical beam.

Referring now to the drawings, FIG. 1 shows schematically a typical radiation pattern for a symmetrical beam 300, the beam 300 therefore having axial symmetry about its direction of travel. As is well known, in practice the beam 300 will usually consist of a central main lobe 301 having power density I and no or plural side lobes 302 of lesser power density, said main lobes and side lobes being separated by regions of low or substantially zero power density. Typically, the power density of the side lobes reduces as the angle subtended by the side lobe relative to the main lobe 300 increases. By convention, the beam width 303 is taken to be the angle subtended at the antenna transmitting the beam 300 by the half power points 304 of the main lobe 301 of the beam 300, i.e. the points 304 where the power density of the main lobe 301 of the beam 300 is 3 dB less than the maximum power density I.

Referring now to FIGS. 2A and 2B, in accordance with the present invention, a transmitted beam 400 is asymmetrical such that its beam width 401 in elevation is greater than its beam width 402 in azimuth. In other words, the angle subtended at the antenna transmitting the beam 400 by the half power points 403,404 of the main lobe 405 of the beam 400 is greater in elevation than in azimuth, as shown by FIGS. 2A and 2B respectively. As has been described above, this has many advantages, especially when used in the context of a mesh communications network which uses a multiplicity of point-to-point wireless transmissions between nodes. It will be understood that in practice, the beam 400 is likely to be transmitted in a horizontal or substantially horizontal direction (i.e. the beam direction is centred in elevation on or near the horizontal plane, typically within about ±5° of the horizontal plane).

Figure 3:
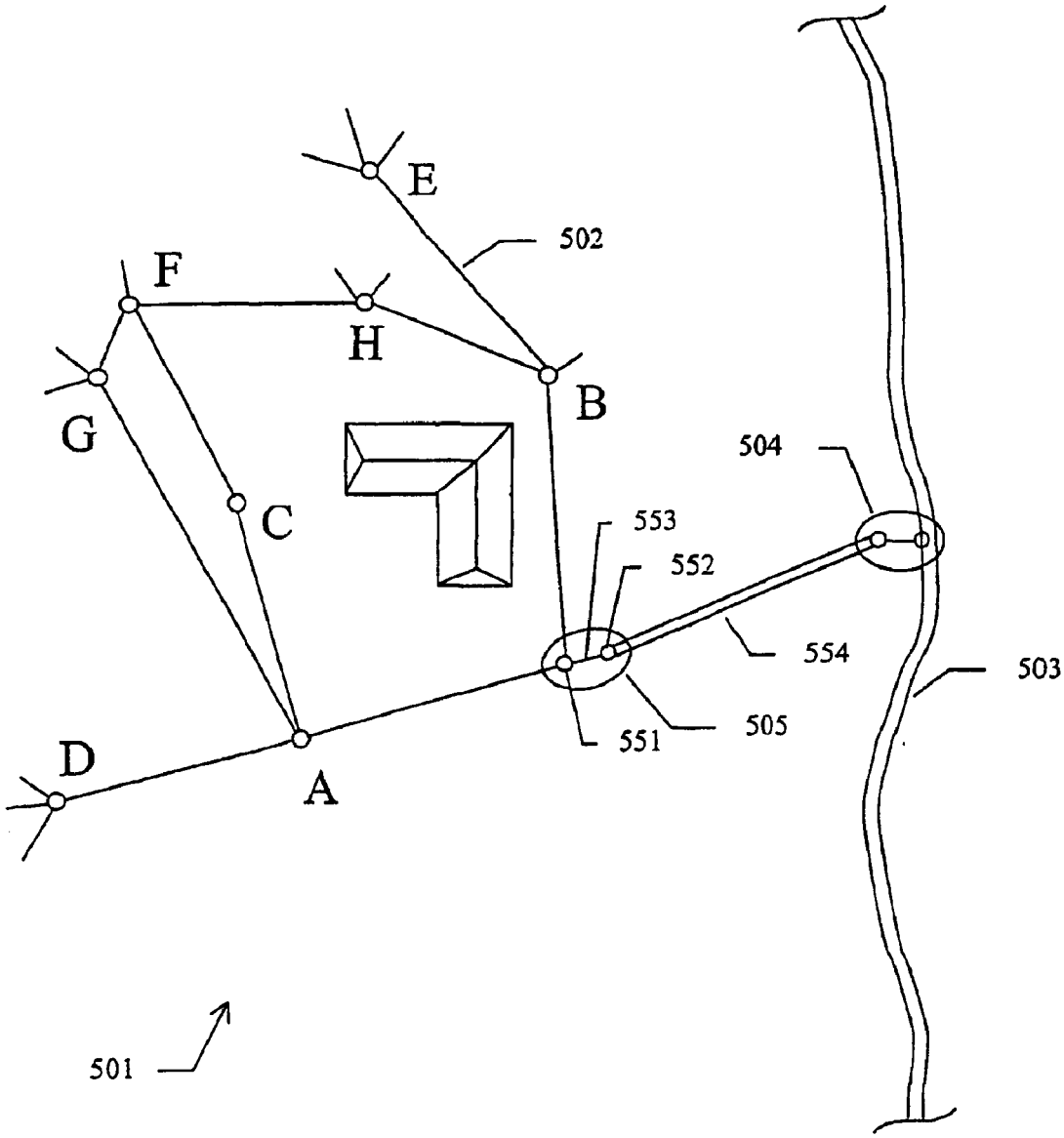
FIG. 3 is a schematic representation of a portion of a mesh communications network; and, FIG. 4A and FIG. 4B show schematically a rear view and a lateral cross-sectional view of an example of an antenna.

Referring now to FIG. 3, there is shown schematically an example of such a communications network 501. The network 501 has plural nodes A–H (only eight being shown in FIG. 3) which are logically and physically connected to each other by respective point-to-point data transmission links 502 between pairs of nodes A–H in order to provide a mesh of interconnected nodes. The links 502 between the nodes A–H are provided by substantially unidirectional (i.e. highly directional) radio transmissions, i.e. each signal is not broadcast but is instead directed to a particular node, with signals being capable of being passed in both directions along the link 502. The transmission frequency will typically be at least 1 GHz and may be for example 2.4 GHz, 4 GHz, 28 GHz, 40 GHz, 60 GHz or even 200 GHz. Beyond radio frequencies, other yet higher frequencies such as of the order of 100,000 GHz (infra-red) could be used.

Each node A–H has plural antennas which provide for the potential point-to-point transmission links to other nodes. In a typical example, each node A–H has four antennas and so can be connected to up to four or more other nodes. In the example shown schematically in FIG. 3, the mesh 501 of interconnected nodes A–H is connected to a trunk 503. The point at which data traffic passes from the trunk 503 is referred to herein as a trunk network connection point ("TNCP") 504. The connection between the TNCP 504 and the mesh network 1 will typically be via a mesh insertion point ("MIP") 505. The MIP 505 will typically consist of a standard node 551 which has the same physical construction as the nodes A–H of the mesh network 501 and which is connected to a specially adapted node 552 via a feeder link 553. The specially adapted node 552 provides for a high data transfer rate connection via suitable (radio) links 554 to the TNCP 504 which, in turn, has suitable equipment for transmitting and receiving at these high data transfer rates.

By providing a beam that has a beam width that is narrow in azimuth, the spectral efficiency of the communications network 501 can be increased. This is because, in a typical implementation, the same frequency may be used at plural different spatial locations and this reuse of the same frequency can lead to interference of the wanted signals at a node by unwanted signals from other nodes, the unwanted interference including a multiplicity of interfering transmissions, for example co-channel interference caused by other wireless transmissions that are using the same frequency and adjacent channel interference caused by wireless transmissions using adjacent frequencies. By using asymmetric directional antennas in a mesh system as described above, the aggregate levels of both co-channel interference and adjacent channel interference can be reduced and this allows more reuse of the frequencies for a given level of interference and/or a reduction in the absolute level of interference and/or a reduction in the amount of spectrum required to service a set of users. In general, the spectral efficiency decreases with the square of the beam width in azimuth. Furthermore, given that the node to which transmissions are being directed may be at a different elevation to the node from which transmissions are being sent, having a beam width that is relatively wide in elevation (i.e. a tall beam) means that the beam is more likely to reach the target node without the transmitting antenna having to be steered in elevation. In other words, whilst in practice it may be desirable or even necessary for the antenna of the transmitting node to be steerable in azimuth, an asymmetric beam makes it less likely that the antenna of the transmitting node needs to be steerable in elevation. It will be appreciated that if it is desirable or necessary for the antenna of the transmitting node to be steerable in azimuth, then said antenna can be mechanically steerable or electronically steerable or both, possibly with mechanical steering being used for coarse steering and electronic steering being used for fine steering once the antenna is directed in approximately the correct direction. Similar considerations apply for the antenna at the receiving node.

A further advantage of the asymmetric beam is that it is can reduce the effect of wind loading on the antenna, which can be important in practice in those implementations in which the antenna apparatus is mounted outdoors. For example, for an antenna mounted on a pole or the like, the effect of wind loading is typically to bend the pole to cause the antenna supports to tilt away from the horizontal plane. This movement of the antenna can lead to significant depointing in the elevation plane, while producing no or less depointing in the azimuth plane. Having a beam width that is greater in elevation means that the antenna apparatus is less sensitive to the depointing effects of wind loading.

A yet further advantage of the asymmetric beam is its effect on the overall height of the antenna apparatus. In particular, to produce a beam that has a beam width that is narrower in azimuth than in elevation, the antenna will typically be relatively short from top to bottom (to produce a relatively large beam width in elevation) and relatively wide from side to side (to produce a relatively narrow beam in azimuth). This means that the overall height of the antenna apparatus can be less for corresponding frequencies and antenna gain than if for example a symmetrical beam were used. It will be understood that planning regulations and also aesthetics may mean that a relatively short antenna apparatus is highly desirable. Examples of support structures for the antennas are disclosed in our copending International patent application no. (agent's ref P8196WO).

Moreover, for a given size of antenna, higher gain and directivity (i.e. reduced beam width) can be achieved by increasing the frequency. In the typical implementation, where the antenna apparatus is associated with a node in a mesh communications system of the type described above, this effect can be used to compensate for the increased path loss that occurs for wireless transmission links that are operating at higher frequencies. For example, if a node is redesigned to operate at a higher frequency while keeping the overall dimensions of the antenna the same, then the antenna can be designed to provide a higher gain (for said given dimensions) and this can compensate for the increased path loss when operating at said higher frequencies.

It is preferred that the antenna at the receiving node as well as the antenna at the transmitting node be arranged so that its beam width is greater in elevation than in azimuth as, in most practical implementations, this will maximise the benefits that may be obtained.

In a mesh communications network as described above, the nodes are typically arranged so that wireless transmissions between the nodes take place at a frequency in the range 1 GHz to 100 GHz. Specific preferred frequencies are in the range about 24 GHz to about 30 GHz or in the range about 40 GHz to about 44 GHz. For frequencies in the range about 24 GHz to about 30 GHz, a beam width in azimuth in the range 5° to 7° and a beam width in elevation in the range 9° to 12° is preferred. For frequencies in the range about 40 GHz to about 44 GHz, a beam width in azimuth in the range 3.5° to 5° and a beam width in elevation in the range 6.5° to 9.5° is preferred. In general, as the frequency increases, the beam width in both azimuth and elevation decreases.

Figure 4A:
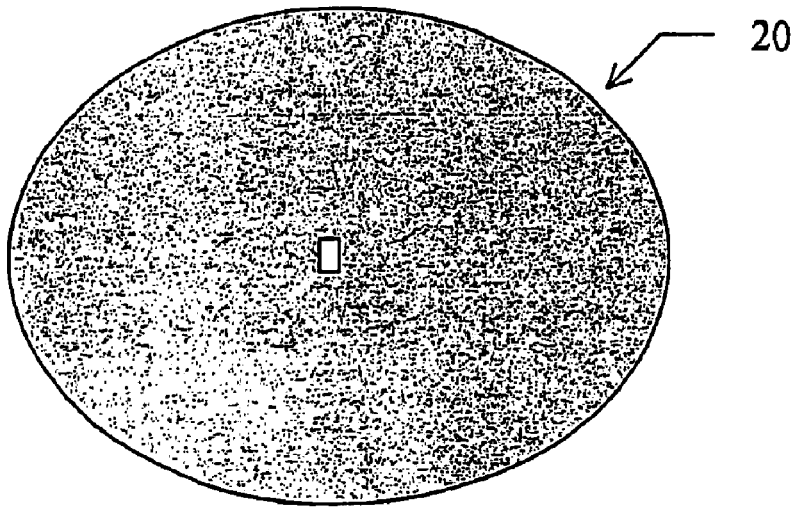
Figure 4B:
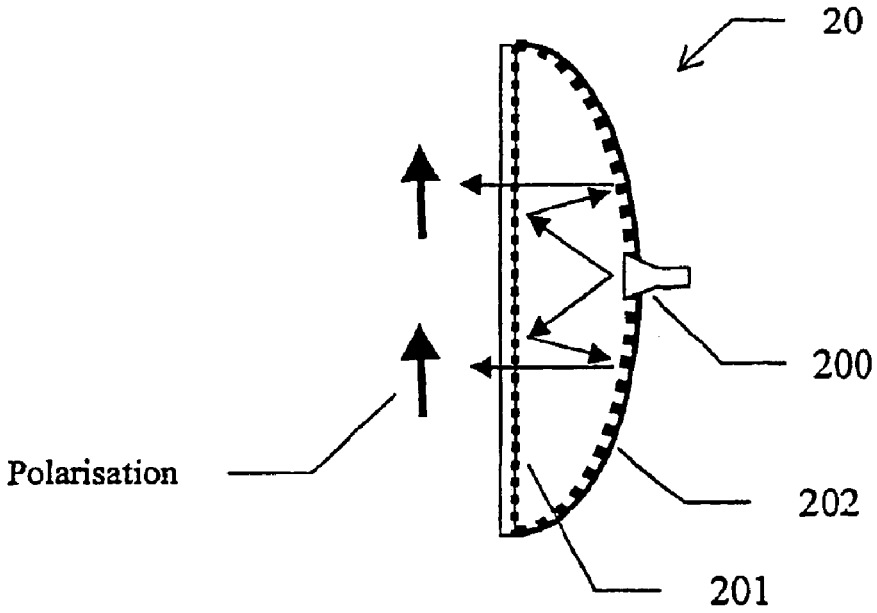

Referring now to FIGS. 4A and 4B, a preferred antenna 20 is shown, which is known as a twist reflector antenna. A linearly polarised feed horn 200 illuminates a polarisation-sensitive flat sub-reflector 201 as shown by arrows that show the direction of propagation of the TEM wave. The energy is reflected by the sub-reflector 201 onto a parabolic corrugated main reflector 202. The corrugations of the main reflector 202 are arranged so as to twist the polarisation of the beam through 90° on reflection. By virtue of this twist of the polarisation, when the energy again impinges on the flat sub-reflector 201, it passes through into the far field. It should be noted that the corrugations of the main reflector 202 are arranged so as to create a precise phase shift which affects the polarisation twist on reflection, the phase shift being frequency dependent. Similarly, the thickness of the sub-reflector 201 is in general chosen such that reflection from its innermost and outermost surfaces are cancelled, which is again a frequency-dependent effect.

The basic antenna described briefly above is described more fully in WO-A-98/49750, the entire content of which is incorporated herein by reference. However, because as discussed above it is preferred that the beam transmitted by the antenna 20 be asymmetric and particularly that it be narrower in azimuth than it is tall in elevation, the main reflector 202 and correspondingly the sub-reflector 201 in the preferred embodiment are elliptical and arranged with their minor axes vertical.

An embodiment of the present invention has been described with particular reference to the examples illustrated. However, it will be appreciated that variations and modifications may be made to the examples described within the scope of the present invention.

What is claimed is:

1. A communications apparatus comprising:

a plurality of nodes, each node being capable of communicating with plural other nodes via point-to-point wireless transmission links between the nodes; at leapt one of the nodes comprising at least one antenna that is steerable in azimuth, wherein the at least one antenna is arranged to transmit an electromqgnetic beam that has a beam width that is narrower in azimuth than in elevation, the beam width in azimuth being less than about 9° and the beam width in elevation being less than about 15°.

2. The apparatus of claim 1, wherein said at least one antenna is arranged so that the transmitted beam is elliptical in cross-section with the major axis in elevation and the minor axis in azimuth.

3. The apparatus of claim 1, wherein said at least one antenna is arranged so that the transmitted beam has a beam width in azimuth that is in the range 2° to 5°.

4. The apparatus of claim 1, wherein said at least one antenna is arranged so that the transmitted beam has a beam width in elevation that is in the range 5° to 10°.

5. The apparatus of claim 1, wherein the nodes are arranged so that wireless transmissions between the nodes take place at a frequency in the range 1 GHz to 100 GHz.

6. A method of wireless transmission between a first node and a second node, the first node having an antenna for wireless transmission of a signal, the second node having an antenna for receiving the wireless transmission from the first node, the method comprising:

transmitting an electromagnetic beam having a beam width that is narrower azimuth than in elevation from the first node to the second node, the beam width in azimuth being less than about 9° and the beam width in elevation being less than about 15°.

7. The method of claim 6, and comprising receiving said electromagnetic beam at the second node with an antenna that has a beam width that is narrower in azimuth than in elevation.

8. The method of claim 6, wherein the antenna of the first node is steerable in azimuth, and comprising, prior to transmitting the electromagnetic beam, steering the antenna of the first node in azimuth to direct the electromagnetic beam towards the antenna of the second node.

9. The method of claim 6, wherein the antenna of the second node is steerable in azimuth, and comprising steering the antenna of the second node in azimuth to direct the antenna of the second node towards the antenna of the first node.

10. The method of claim 6, wherein the transmitted beam is elliptical in cross-section with the major axis in elevation and the minor axis in azimuth.

11. The method of claim 6, wherein the antenna of the first node is arranged so that the transmitted beam has a beam width in azimuth that is in the range 2° to 5°.

12. The method of claim 6, wherein the antenna of the first node is arranged so that the transmitted beam has a beam width in elevation that is in the range 5° to 10°.

13. The method of claim 6, wherein wireless transmissions between the nodes take place at a frequency in the range 1 GHz to 100 GHz.

14. An antenna apparatus for use in a communications apparatus which includes a plurality of nodes, each node being capable of communicating with plural other nodes via point-to-point wireless transmission links between the nodes, the antenna apparatus comprising:

at least one antenna that is steerable in azimuth, wherein the at least one antenna is arranged to transmit an electromagnetic beam that has a beam width that is narrower in azimuth than in elevation, the beam width in azimuth being less than about 9° and the beam width in elevation being less than about 15°.

15. The apparatus of claim 14, wherein said at least one antenna is arranged so that the transmitted beam is elliptical in cross-section with the major axis in elevation and the minor axis in azimuth.

16. The apparatus of 14, wherein said at least one antenna is arranged so that the transmitted beam has a beam width in azimuth that is in the range 2° to 5°.

17. The apparatus of claim 14, wherein said at least one antenna is arranged so that the transmitted beam has a beam width in elevation that is in the range 5° to 10°.

18. The apparatus of claim 14, wherein the apparatus is arranged so that wireless transmissions take place at a frequency in the range 1 GHz to 100 GHz.

19. The apparatus of claim 1, wherein the at least one antenna is at least one of mechanically steerable and electronically steerable.

20. The method of claim 6, wherein the antenna of the first node is at least one of mechanically steerable and electronically steerable.

21. The apparatus of claim 14, wherein the at least one antenna is at least one of mechanically steerable and electronically steerable.

* * * * *

UNITED STATES PATENT AND TRADEMARK OFFICE

CERTIFICATE OF CORRECTION

PATENT NO. : 7,327,323 B2
APPLICATION NO. : 10/450191
DATED : February 5, 2008
INVENTOR(S) : Jackson et al.

It is certified that error appears in the above-identified patent and that said Letters Patent is hereby corrected as shown below:

In column 9, at line 33, delete “leapt” and insert --least--.

Signed and Sealed this

Twenty-sixth Day of August, 2008

JON W. DUDAS
*Director of the United States Patent and Trademark Office*